US012097445B2

(12) United States Patent
Monteverde

(10) Patent No.: US 12,097,445 B2
(45) Date of Patent: Sep. 24, 2024

(54) TOY BUILDING ELEMENT AND TOY BUILDING SET

(71) Applicant: Fulvio Monteverde, Venaria Reale (IT)

(72) Inventor: Fulvio Monteverde, Venaria Reale (IT)

( * ) Notice: Subject to any disclaimer, the term of this patent is extended or adjusted under 35 U.S.C. 154(b) by 221 days.

(21) Appl. No.: 17/908,178

(22) PCT Filed: Apr. 2, 2021

(86) PCT No.: PCT/IB2021/052783
§ 371 (c)(1),
(2) Date: Aug. 30, 2022

(87) PCT Pub. No.: WO2021/199001
PCT Pub. Date: Oct. 7, 2021

(65) Prior Publication Data

US 2023/0082807 A1 Mar. 16, 2023

(30) Foreign Application Priority Data

Apr. 3, 2020 (IT) ..... 102020000007156

(51) Int. Cl.
*A63H 33/10* (2006.01)
*A63H 3/04* (2006.01)
*A63H 33/06* (2006.01)

(52) U.S. Cl.
CPC ..... *A63H 33/062* (2013.01); *A63H 33/107* (2013.01)

(58) Field of Classification Search
CPC ..... A63H 33/04; A63H 33/06; A63H 33/062; A63H 33/08; A63H 33/088; A63H 33/10; A63H 33/107; A63H 33/108
(Continued)

(56) References Cited

U.S. PATENT DOCUMENTS 2,885,822 A * 5/1959 Onanian ..... A63H 33/101 174/138 D
3,611,609 A * 10/1971 Reijnhard ..... A63H 33/101 446/128

(Continued)

FOREIGN PATENT DOCUMENTS

| | | |
|---|---|---|
| DE | 2446475 | 4/1976 |
| KR | 101988415 | 6/2019 |
| WO | 2011037417 | 3/2011 |

OTHER PUBLICATIONS

International Search Report and Written Opinion issued in connection with International Application No. PCT/IB2021/052783 and dated Jun. 29, 2021 (13 pages).

(Continued)

*Primary Examiner* — Alexander R Niconovich
(74) *Attorney, Agent, or Firm* — KLINTWORTH & ROZENBLAT IP LLP

(57) ABSTRACT

The invention relates to a toy building element for a modular building game. The toy building element comprises one or more hollow coupling studs for coupling the toy building element to another toy building element in a releasable manner. Each coupling stud extends along a respective longitudinal axis and defines internally an axial through cavity configured to receive, in a removable manner, a locking stud apt to lock the toy building element to another toy building element coupled thereto. Each coupling stud comprises a coupling part and a receiving part for receiving the coupling part of a coupling stud of another toy building element. The coupling part comprises at least a radially flexible portion for engaging/disengaging a receiving part of a coupling stud of another toy building element. The radially flexible portion is configured to cooperate with one said locking engaging the cavity so that its radial bending is limited by the locking stud so as to prevent the coupling part (Continued)

from disengaging from the receiving part of a coupling stud of another toy building element.

9 Claims, 6 Drawing Sheets

(58) Field of Classification Search
USPC ..... 446/85, 120, 121, 122, 124, 128
See application file for complete search history.

(56) References Cited

U.S. PATENT DOCUMENTS 4,551,110 A * 11/1985 Selvage ..... A63H 33/12 411/509
4,823,532 A * 4/1989 Westerburgen ..... A63H 33/08 446/128
6,102,766 A * 8/2000 Leadbetter ..... A63H 33/086 446/124
6,736,691 B1 * 5/2004 Bach ..... A63H 33/101 446/116
7,267,598 B2 * 9/2007 Glickman ..... A63H 33/086 446/124
7,517,270 B2 * 4/2009 Marzetta ..... A63H 33/101 446/85
7,736,211 B2 * 6/2010 Marzetta ..... A63H 33/106 446/85
7,942,717 B2 * 5/2011 Chou ..... G06T 17/10 446/85
8,905,812 B2 * 12/2014 Pai-Chen ..... A63H 33/107 446/124
9,010,059 B2 * 4/2015 Lin ..... A63H 33/107 52/603
9,044,690 B2 * 6/2015 Uttley ..... A63H 33/102
9,839,860 B2 * 12/2017 Rakhsha ..... A63H 33/04
10,888,797 B2 * 1/2021 De Wilde ..... A63H 17/262
11,577,176 B2 * 2/2023 Ye ..... A63H 33/102
2007/0123137 A1 5/2007 Marzetta
2008/0075528 A1 * 3/2008 Marzetta ..... A63H 33/108 403/238
2014/0273712 A1 9/2014 Uttley et al.
2021/0331084 A1 * 10/2021 Rasmussen ..... A63H 33/086
2022/0347594 A1 * 11/2022 Marzetta ..... A63H 33/101

OTHER PUBLICATIONS

Italian Search Report and Written Opinion issued in connection with Italian Application No. IT202000007156 and dated Nov. 20, 2020 (8 pages).
Request for PCT Direct processing of International Application claiming priority to Italian Patent Application No. 102020000007156, dated Apr. 1, 2021 (3 pages).

* cited by examiner 1
2
2a
2''
3
4
5
6
7
8
10
11
12
13
14
15
B

TOY BUILDING ELEMENT AND TOY BUILDING SET

CROSS-REFERENCE TO RELATED APPLICATIONS

This patent application claims priority from Italian patent application no. 102020000007156 filed on Mar. 4, 2020 the entire disclosure of which is incorporated herein by reference.

TECHNICAL FIELD OF THE INVENTION

The present invention relates to a toy building element for a modular building game.

The present invention also relates to a toy building set comprising a plurality of toy building elements couplable to one another in a releasable manner.

STATE OF THE ART

Toy building sets comprising a plurality of toy building elements couplable, i.e. that can be coupled, to one another in a releasable manner are known.

Generally, each set comprises various types of toy building elements, distinct in shape and size, and configured to be coupled to one another with the aim of creating a modular toy construction formed precisely by the union of the various toy building elements according to a predefined or random scheme.

Typically, the toy building elements are made of a plastic material, have a substantially prismatic shape, most often parallelepipedal with a rectangular base, and each comprise one or more coupling studs, arranged at a first surface of the toy building element, and corresponding cavities, obtained at a second surface opposite the first and configured to receive coupling studs of another toy building element, according to an interference coupling.

In this way, a releasable coupling between the various toy building elements is achieved, which can be uncoupled by means of a simple pulling force applied to the same.

However, the Applicant has observed that, in some cases, this coupling proves to be too unstable; for example, in cases where the toy construction falls out of the hands of the user and brakes into pieces, or in cases where a disassembly of the completed construction is to be avoided. The latter is the case, for example, with collectable constructions, which are very laborious to create and usually, once completed, need to be maintained intact.

There is thus felt to be a need to provide toy building elements that can be coupled to one another in a strong and durable yet simultaneously releasable manner.

OBJECT AND SUMMARY OF THE INVENTION

The object of the present invention is to provide a toy building element which is highly reliable, of limited cost and enables the satisfaction of the requirement specified above pertaining to toy building elements of a known type.

According to the invention, this object is achieved by a toy building element as claimed in claim 1.

DETAILED DESCRIPTION OF PREFERRED EMBODIMENTS OF THE INVENTION

With reference to the attached figures, a toy building set for a modular building game is indicated as a whole by number 1.

Figure 1:
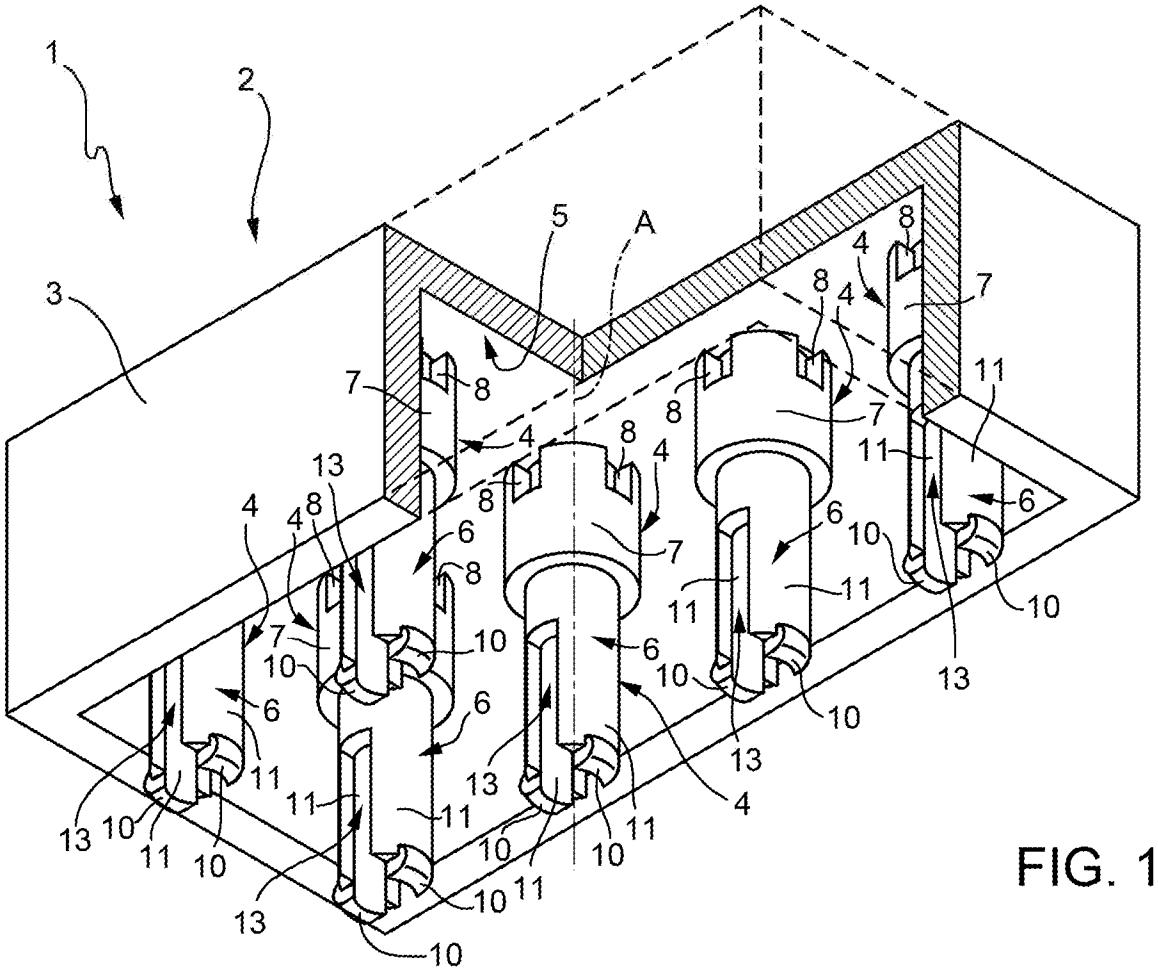
FIG. 1 is a perspective view, with parts removed for the sake of clarity, of a toy building element realized according to a first embodiment of the present invention.

The set 1 comprises a plurality of toy building elements 2, one of which is illustrated in FIG. 1.

In particular, the toy building elements 2 can be coupled to one another in a releasable manner with the aim of creating a modular toy construction (not illustrated) formed precisely by the union of the various toy building elements 2 according to a predefined or random scheme.

Preferably, the set 1 comprises various types of toy building elements 2, which are distinct from one another in shape and size. However, for the sake of brevity, a single preferred form and type of toy building element 2 will be illustrated and described in the following.

Preferably, the toy building elements 2 are made of a plastic material.

Figure 2:
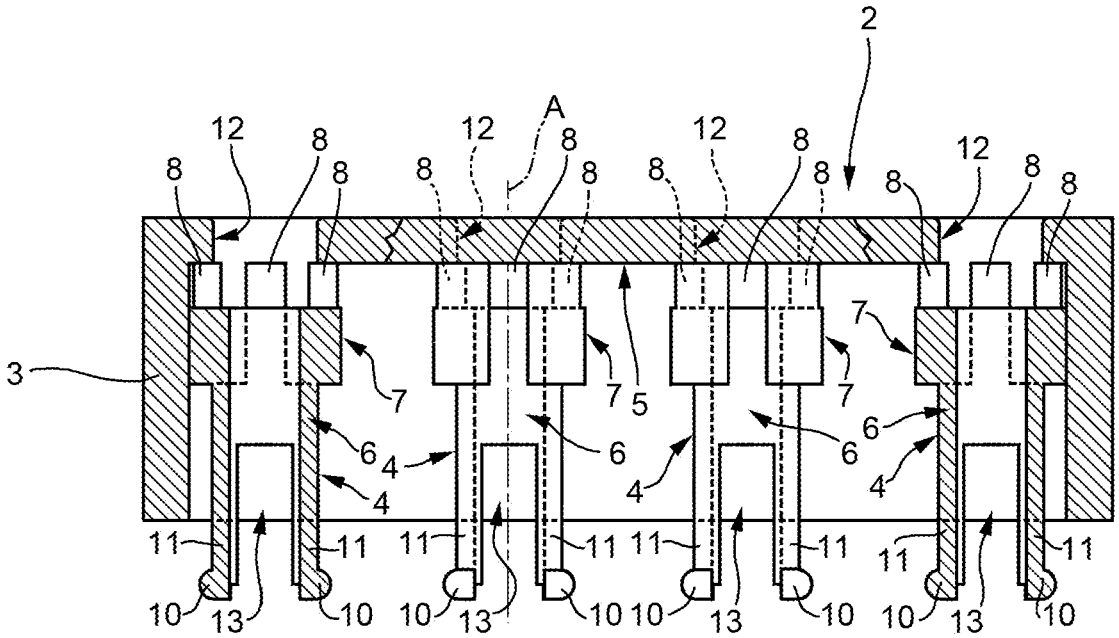
FIG. 2 is a side view, partially sectioned and with parts removed for the sake of clarity, of the toy building element of FIG. 1.

As is visible in FIGS. 1 and 2, each toy building element 2 comprises a base body 3, having a substantially prismatic form; and one or more coupling studs 4 carried by, in particular fixed to, the base body 3 and configured to couple the toy building element 2 to another toy building element 2 in a releasable manner.

According to this preferred and non-limiting embodiment, each toy building element 2 comprises coupling studs 4 and the base body 3 is defined by a parallelepipedal box-shaped body with a rectangular base and open at one of the two rectangular faces with a larger surface area.

In detail, the coupling studs 4 each have a longitudinal axis A and are fixed at an inner bottom surface 5 of the base body 3 arranged on the side facing and opposite said opening.

In practice, the base body 3 has the shape of a rectangular box open "at the top" and containing in its interior the coupling studs 4, fixed to the bottom surface 5 of said box.

More specifically, the coupling studs 4 of each toy building element 2 extend orthogonally from the respective bottom surface 5 along their respective axes A and are arranged with their respective axes A parallel to one another.

In the following, reference will be made to a single toy building element 2 of the set 1. However, the described and illustrated characteristics are applicable to each toy building element 2 of the set 1.

Each coupling stud 4 comprises a coupling part 6 and a receiving part 7 configured to receive the coupling part 6 of a coupling stud 4 of another toy building element 2 so as to establish the aforementioned releasable coupling between said toy building elements 2.

More specifically, the receiving part 7 of each coupling stud 4 is fixed to the base body 3, in particular to the bottom surface 5 of the base body 3.

In particular, the receiving part 7 is radially non-deformable, i.e. it is non-deformable radially when subjected to a stress typically applied during the use of the toy building element 2.

In other words, the receiving part 7 is also radially non-deformable when it is coupled with the relative coupling part 6.

Each coupling part 6 is fixed to the respective receiving part 7; in particular, each coupling part 6 extends integrally, along the respective axis A, from the respective receiving part 7 in one seamless piece.

Preferably, each receiving part 7 extends integrally from the bottom surface 5 in such a manner that the base body 3 and the coupling studs 4 are made from one seamless piece.

Conveniently, each coupling stud 4 internally defines an axial through cavity 13, in particular coaxial with the relative axis A, configured to receive, in a removable manner, a locking stud 14 apt to lock the respective toy building element 2 to another toy building element 2 coupled thereto, according to a mode explained in the following.

More specifically, the cavity 13 of each coupling stud 4 defines a through-hole over the entire axial length of the coupling stud 4 and is delimited, over a first portion, by the receiving part 7 and, over a second portion, by the coupling part 6.

Conveniently, each coupling part 6 comprises at least a radially flexible portion 11 for engaging/disengaging a receiving part 7 of a coupling stud 4 of another toy building element 2.

In detail, each cavity 13 has a widened portion arranged at the relative receiving part 7 and defining at least one seat 8, in particular a radial seat 8, apt to house at least part of said radially flexible portion 11.

In greater detail, the radially flexible portion comprises at least one axial flap 11 shaped so as to delimit at least part of the relative cavity 13 and apt to bend radially to engage/disengage a corresponding seat 8 of a receiving part 7 of a coupling stud 4 of another toy building element 2.

To this end, the flap 11 comprises at least one engaging element 10 configured to engage a corresponding seat 8 radially, during the step of coupling a toy building element 2 carrying such a flap 11 (and thus such an engaging element 10) and another toy building element 2 carrying such a seat 8.

In particular, the flap 11 is defined by a lamellar protuberance that extends axially from the relative receiving part 7, at a first fixed end of the same, and carrying, at a second free end of the same, axially opposite the first end, a respective engaging element 10.

In accordance with the foregoing description, each radially flexible portion, i.e. each flap 11, extends integrally in one seamless piece from the respective receiving part 7.

According to the preferred and non-limiting embodiment described herein, each radially flexible portion comprises two flaps 11 opposite one another, arranged on opposite sides of the relative cavity 13 and apt to engage, with the engaging means 10 of the same, corresponding seats 8 of the receiving part 7 of a coupling stud 4 of another toy building element 2, causing in this manner an interlocking of the coupling part 6 and the corresponding receiving part 7 and, thus, the aforementioned releasable coupling between the toy building elements 2.

In light of the foregoing description, each receiving part 7 is axially hollow and further comprises an opening 12 coaxial with the relative axis A and configured to receive the free end of the coupling part 6 of a coupling stud 4 of another toy building element 2; the opening 12 is thus configured to be engaged by at least part of the flaps 11.

In particular, the opening 12 defines an axial opening into the cavity 13 and through the bottom surface 5 so as to define a through-hole through said bottom surface 5.

In use, during the coupling of a first toy building element 2 with a second toy building element 2, the coupling part 6 of the coupling studs 4 of the first toy building element 2 engages, through the relative openings 12, the receiving part 7 of the coupling studs 4 of the second toy building element 2.

Figure 3:
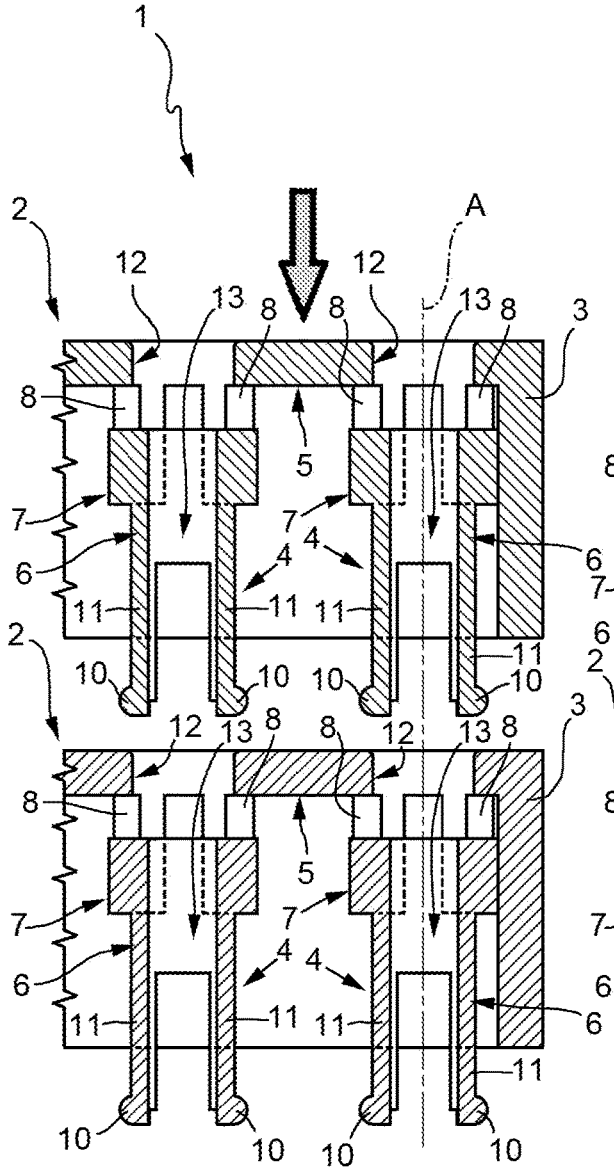
FIGS. 3 and 4 illustrate, in a partially sectioned side view and with parts removed for the sake of clarity, two toy building elements during two distinct operating conditions.
Figure 4:
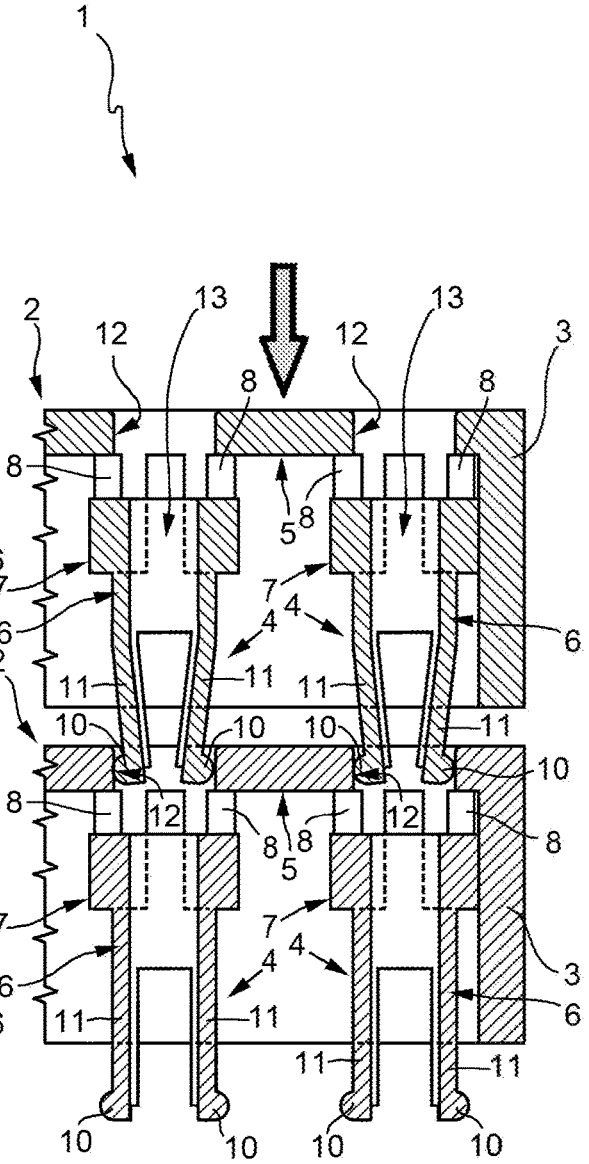

More precisely, as shown in FIGS. 3 and 4, for each pair of coupling studs 4 coupled to one another, the radially flexible portion, and thus the free ends of the flaps 11, engages the opening 12.

Conveniently, the opening 12 has a smaller cross section than the maximum radial extension of the free ends of the flaps 11, i.e. than the maximum radial distance between the outer surfaces of the engaging elements 10 and the relative axis A.

Thanks to this configuration, the flaps 11, once engaged in the opening 12, bend, pushed by the inner walls of the opening 12 towards the respective axis A until they reach the seats 8.

At this point, having past the inner walls of the opening 12, the flaps 11 bend again outwards and, consequently, the engaging elements 10 engage the seats 8 radially.

More precisely, each coupling part 6 of the coupling studs 4 of the first toy building element 2 is configured to engage the corresponding receiving part 7 of the coupling studs 4 of the second toy building element 2 without cooperating with the radially flexible portion, i.e. with the flaps 11, of the coupling part 6 of the coupling studs 4 of the second toy building element 2 (FIGS. 5 and 6), so that this radially flexible portion remains radially deformable (i.e. so that the flaps 11 remain radially deformable) so as to allow each coupling part 6 to disengage from the corresponding receiving part 7, simply by means of the application of a certain pulling force between the first and the second toy building element 2.

More specifically, the flaps 11 also remain radially deformable, i.e. radially bendable, after the coupling of the coupling part 6 with the relative coupling portion 7, since each coupling stud 4 is shaped in such a manner that, after the aforementioned coupling, the coupling part 6 does not interact in contact with said flaps 11. Consequently, the latter are not "locked" in terms of their radial flexibility.

An interlocking, or engaged coupling, of each coupling part 6 of the first toy building element 2 with the corresponding receiving part 7 of the second toy building element 2 is thus achieved and, consequently, the releasable coupling of the first toy building element 2 with the second toy building element 2.

In the preferred and non-limiting example described and illustrated herein, the engaging elements 10 are defined by rounded end protuberances.

Each pair of toy building elements 2 coupled in this manner can be easily uncoupled by applying a certain pulling force, which causes the axial sliding of the flaps 11 in a direction opposite to the direction of coupling, i.e. away from the corresponding seats 8. This causes them to bend inwards again as a result of their sliding on the inner walls of the opening 12 until said flaps 11 exit through the opening 12.

According to this preferred and non-limiting embodiment, the flaps 11 are angularly equispaced around the respective axis A.

Thus, in the case (not illustrated) where each coupling part 6 comprises, for example, three flaps 11, these would be arranged at intervals of 120° around the respective axis A.

According to an important aspect of the present invention, each radially flexible portion is configured to cooperate with one said locking stud 14 engaging the cavity 13 so that its radial bending is limited by the locking stud 14 so as to prevent the coupling part 6 from disengaging from the receiving part 7 of a coupling stud 4 of another toy building element 2.

More precisely, the at least one flap 11 is configured to cooperate with an aforementioned locking stud 14 engaging the relative cavity 13.

In the described example, when a locking stud 14 is inserted inside a relative cavity 13, the radial bending of the flaps 11 towards the respective axis A is limited, in particular prevented, by the presence of said locking stud 14.

Consequently, each locking stud 14, once inserted inside the respective cavity 13, renders the flaps 11 non-deformable radially. In other words, the locking studs 14 engaging the cavities 13 do not allow the flaps 11 to bend radially and thus no longer allow one element 2 to be released from another element 2 coupled thereto, thus establishing a stable and non-releasable coupling as long as the studs 14 are not extracted from the cavities 13.

Appropriately, each locking stud 14 has a cross-section slightly smaller than the cross-section of the cavities 13, so as to engage the same with a minimum of play. This way, once the locking stud 14 has been inserted in a corresponding cavity 13, the respective flaps 11 delimiting this cavity encounter an obstacle (the locking stud 14) which prevents them from bending towards the relative axis A.

Since each cavity 13 extends along the entire axial length of the respective coupling stud 4 so as to define an axial through-hole of the coupling stud 4 extending axially from the opening 12 to an axial opening opposite the opening 12 and delimited, at least partially, by the free ends of the flaps 11, when two or more toy building elements 2 are coupled to one another to establish a construction, the cavities 13 of the respective coupling studs 4 coupled to one another coaxially define a single through-hole of the construction coaxial with the axes A of these coupling studs 4.

According to this preferred and non-limiting embodiment, the flaps 11 of each coupling stud 4 are parallel to one another and parallel to the respective axis A. Consequently, each cavity 13 has a substantially constant cross-section, at least at the relative coupling part 6. In particular, according to the preferred and non-limiting example described herein, each cavity 13 has a substantially circular cross-section.

Conveniently, the aforementioned single through-hole is configured to be engaged by a single locking stud 14.

The configuration described above is illustrated in FIGS. 6 and 7. Since the bending of the flaps 11 is prevented by the presence of the locking stud 14 inserted in the cavity 13, the toy building elements 2 cannot be uncoupled so long as the locking stud 14 is not extracted from the cavity 13.

A strong and durable yet simultaneously releasable coupling between the toy building elements 2 is achieved in this manner.

Preferably, once the toy building elements 2 are coupled to one another, a locking stud 14 is inserted in each cavity 13, in order to provide a stable and strong coupling.

In an alternative embodiment not illustrated, only some of the cavities 13 of each toy building element 2 are engaged with locking studs 14.

Figure 5:
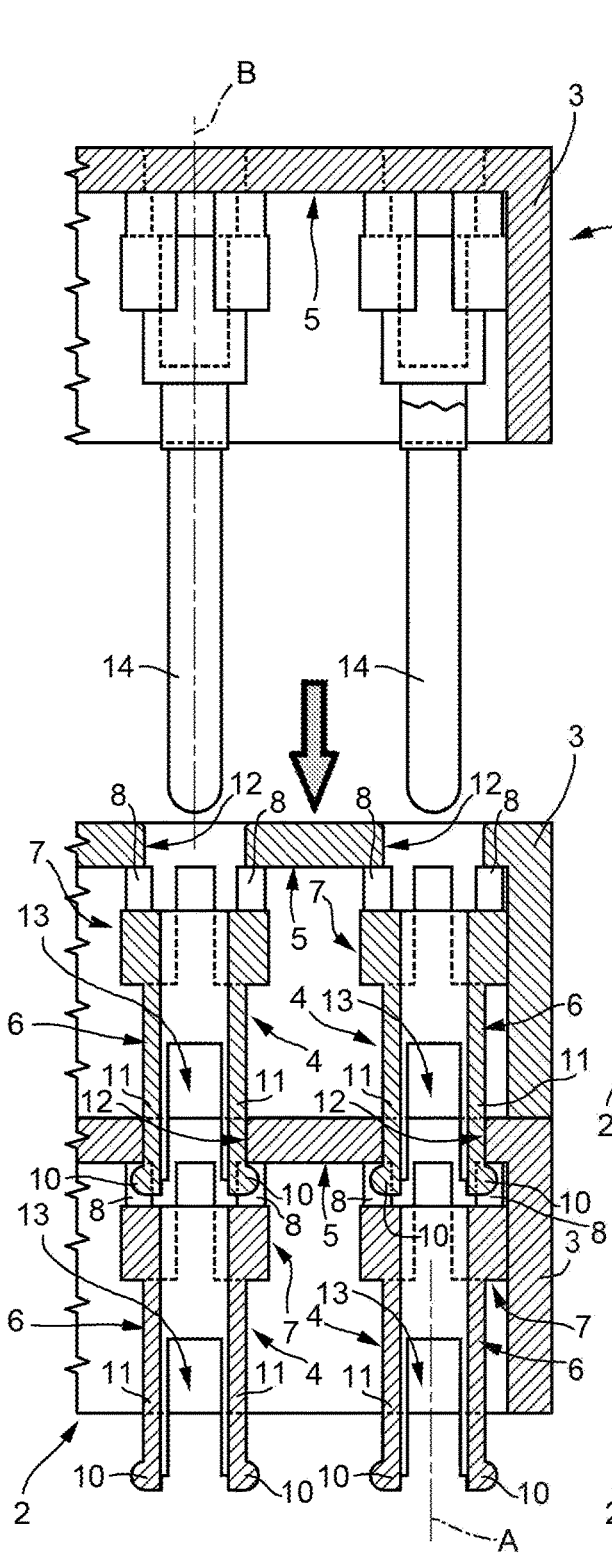
FIGS. 5 and 6 illustrate, in a partially sectioned side view and with parts removed for the sake of clarity, the two toy building elements of FIGS. 3 and 4 coupled to one another and interacting with a locking element, during two distinct operating conditions.
Figure 6:
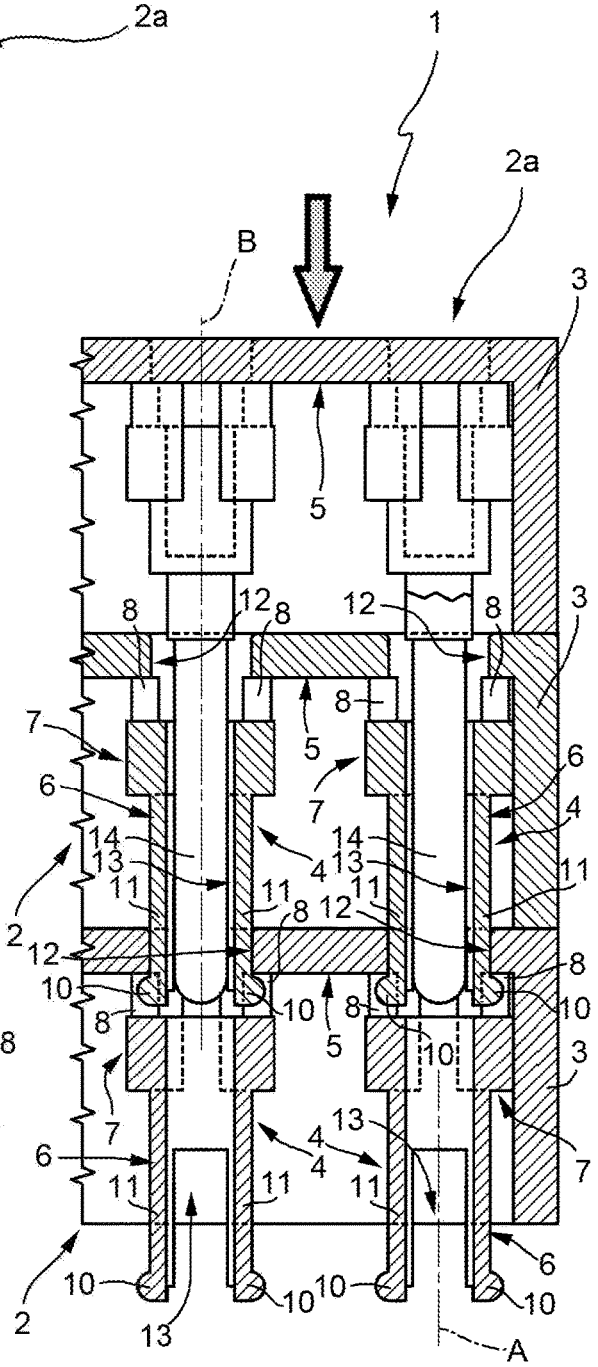

According to the preferred embodiment shown in FIGS. 5 and 6, the set 1 further comprises one or more toy locking elements 2*a*, each couplable in a releasable manner to one or more toy building elements 2 and exclusively carrying one or more locking studs 14 apt to engage respective cavities 13.

In detail, each toy locking element 2*a* is essentially identical to a toy building element 2 of the type described above, except for the fact that it bears locking studs 14 instead of coupling elements 4.

In greater detail, each toy locking element 2*a* comprises a base body 3 to the bottom surface 5 of which the locking studs 14 are affixed.

More specifically, the locking studs 14 extend integrally in one seamless piece from the bottom surface 5, respectively along a longitudinal axis B.

More precisely, the locking studs 14 of each toy locking element 2*a* are arranged with their respective axes B parallel to one another.

In this configuration, the locking studs 14 have a length such that they engage the cavities 13 of a certain predetermined number of toy building elements 2 coupled to one another.

In the preferred and non-limiting example illustrated in FIGS. 5 and 6, the studs are configured to engage the cavities 13 of two toy building elements 2 coupled to one another.

In practice, in use, when two toy building elements 2 are coupled to one another according to the mode described above, a toy locking element 2*a* is coupled to the latter in such a manner that the relative locking studs 14 engage the corresponding cavities 13, coaxially.

In this manner, it is possible to realize a plurality of construction modules that can be combined with one another, each defined by the whole of a toy locking element 2*a* and a certain number of toy building elements 2.

Figure 7:
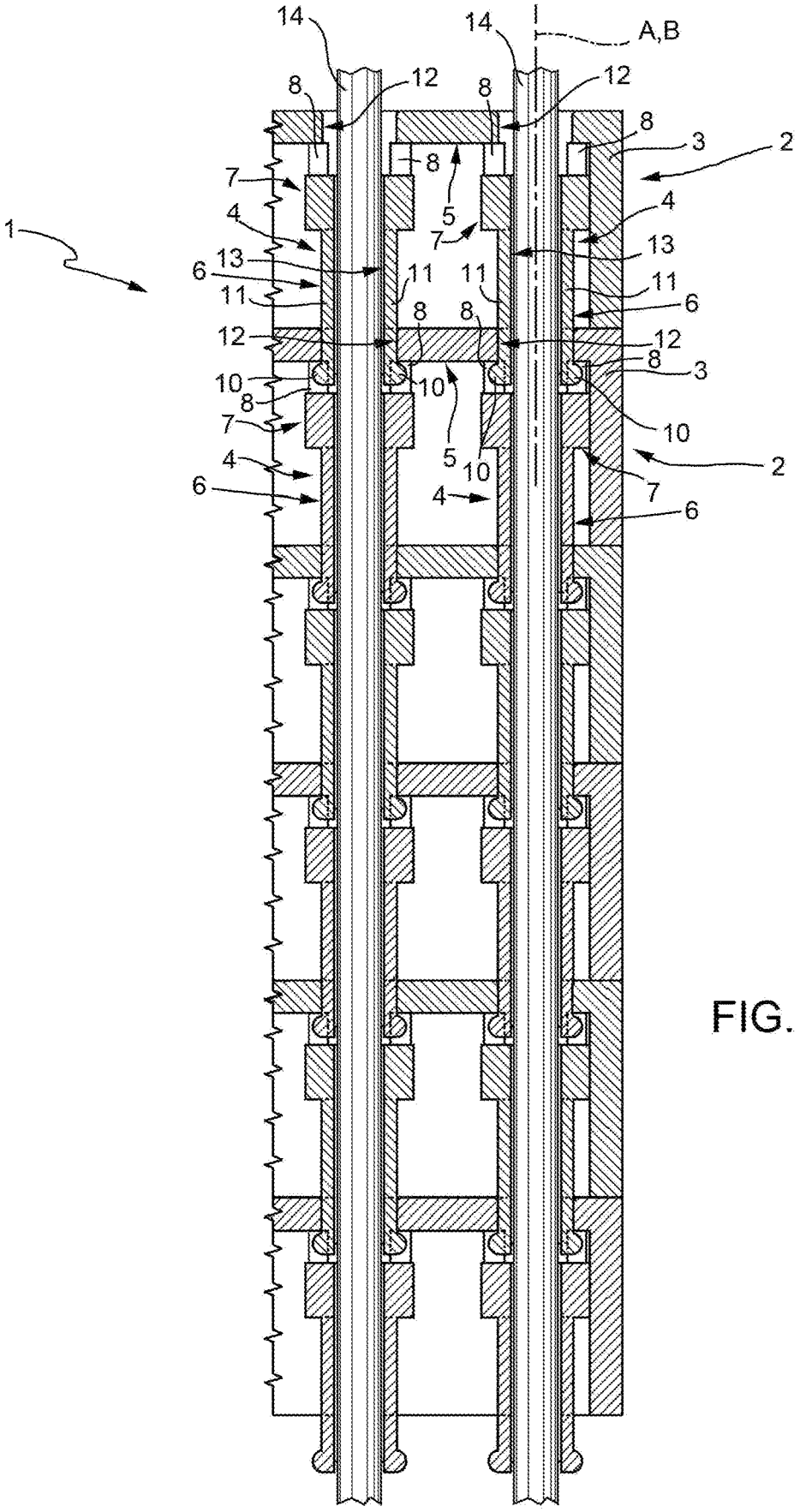
FIG. 7 is a side view, partially sectioned and with parts removed for the sake of clarity, of a plurality of toy building elements coupled to one another according to an alternative mode provided by the present invention.

FIG. 7 illustrates an alternative embodiment of the set 1 in which different toy building elements 2 are coupled to one another by engagement of the respective coupling parts 6 with the receiving parts 7 of other toy building elements 2, as described above.

The cavities 13 of the coupling studs 4 which are coaxial with one another once coupling has been effected define corresponding through-holes which are coaxial with the axes A of said coupling studs 4 and extend over the entire length of the construction.

A single locking stud 14 is also provided in this example for each through-hole defined by the union of the cavities 13 that are coaxial with one another, the locking stud 14 being of a length apt to engage the through-hole over the entire length of the construction.

According to this example, however, the locking studs 14 are independent of one another, i.e. are not carried by (fixed to) any element, as in the case illustrated in FIGS. 5 and 6.

For example, the locking studs 14 according to this embodiment can be formed by a wire element initially wound in a coil and which can be cut at a desired length corresponding to the axial length of the through-hole to be engaged.

According to this configuration, the construction can be easily disassembled at any point of the same, without it being necessary to disassemble the toy building elements 2 sequentially. Indeed, in order to disassemble the construction at any point of the same, it is sufficient to extract the locking studs 14 from the respective cavities 13 and uncouple the toy building elements 2 at the desired point of the construction.

Figure 8:
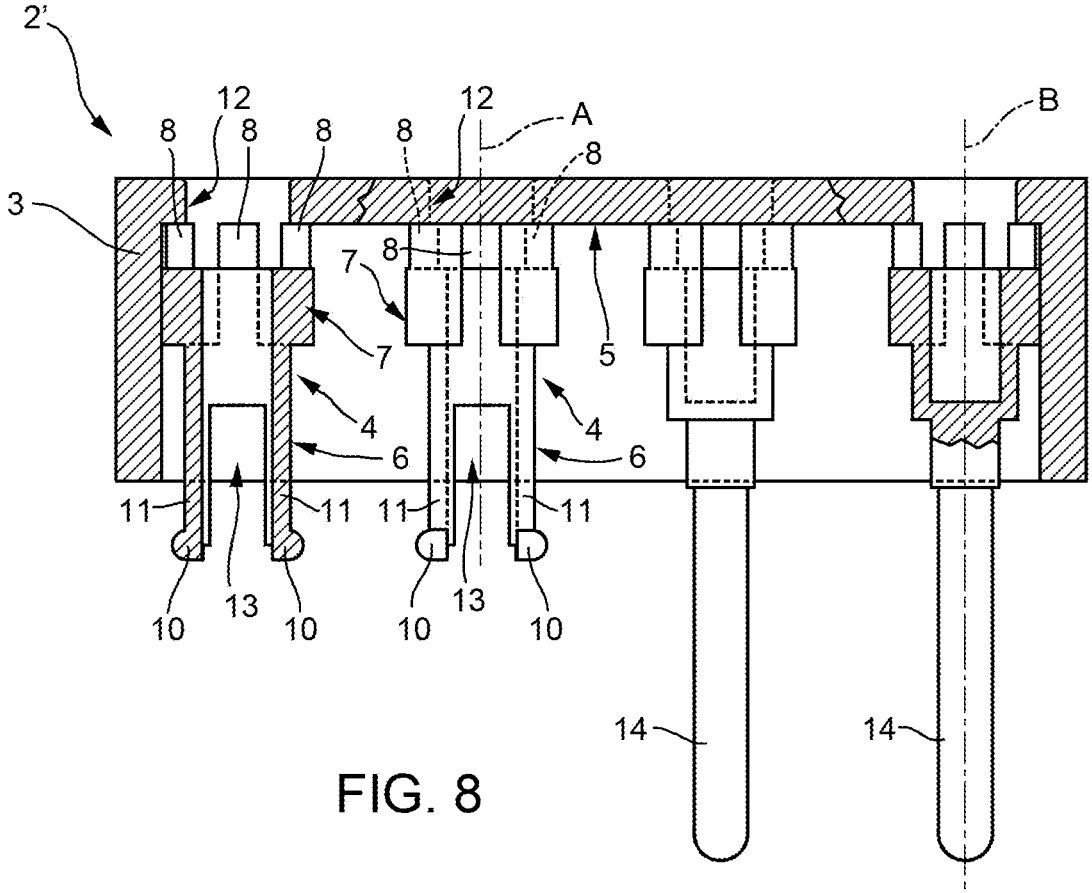
FIG. 8 is a side view, partially sectioned and with parts removed for the sake of clarity, of a toy building element realized according to a second embodiment of the present invention.

With reference to FIG. 8, a toy building element realized in accordance with an alternative embodiment of the present invention is indicated by the number 2'.

Since the toy building element 2' is similar, in terms of structure and function, to the toy building element 2 already described, only the distinctive features with respect to the latter will be explained in the following, while maintaining, wherever possible, the same references for similar or corresponding parts.

In particular, the toy building element 2' differs from the toy building element 2 in that it comprises one or more coupling studs 4 and one or more locking studs 14.

In particular, for each toy building element 2', these locking studs 14 are arranged with their respective axes B parallel to the axes A of the coupling studs 4 carried by said toy building element 2'.

In light of the foregoing description, the set 1 comprises, besides one or more toy building elements 2, 2', a plurality of locking studs 14, whether carried by (fixed to) a toy locking element 2*a* (FIGS. 5 and 6) or not (FIG. 7), configured to be inserted inside corresponding cavities 13.

Figures 9, 10, 11:
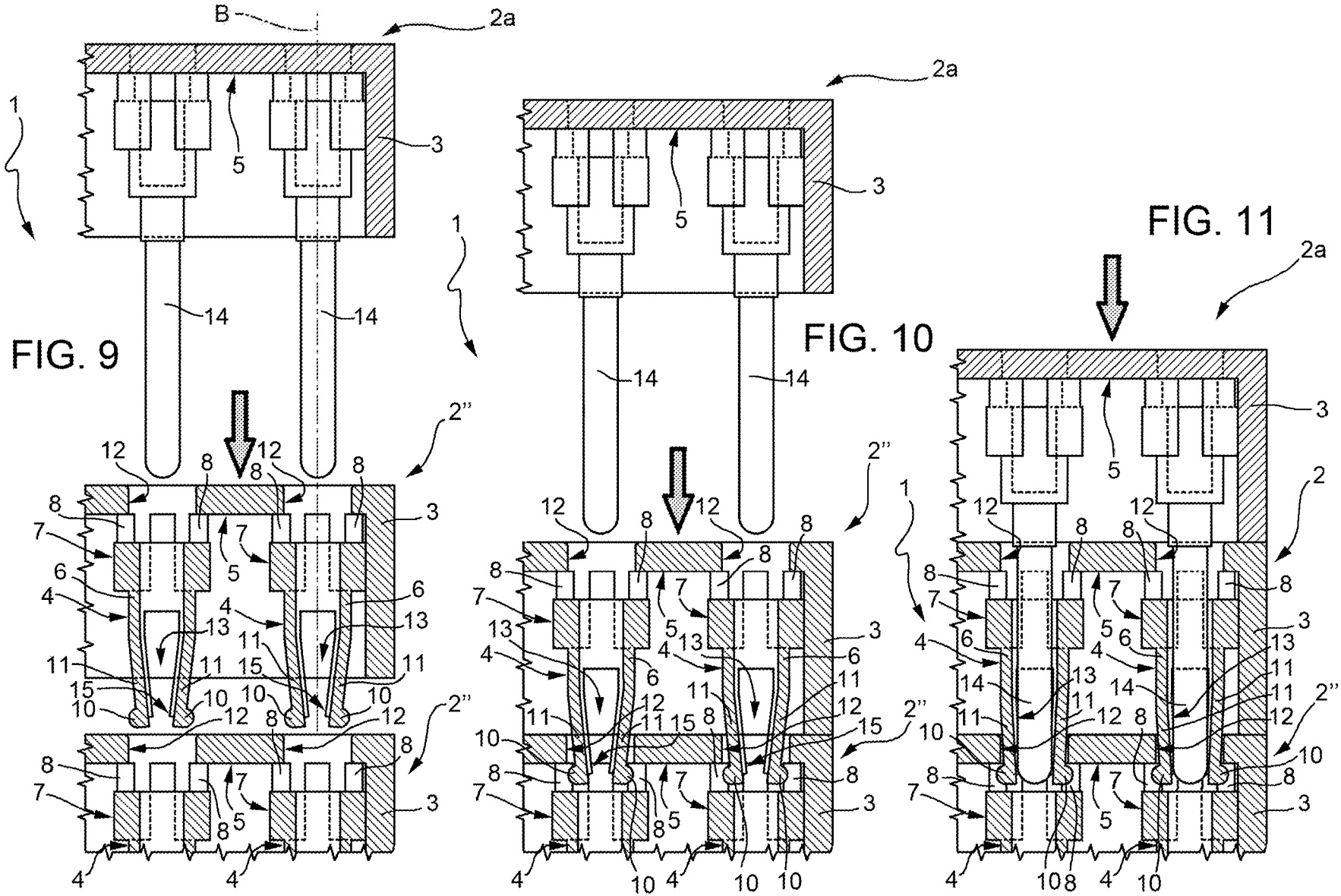
FIGS. 9 to 11 illustrate, in a partially sectioned side view and with parts removed for the sake of clarity, two toy building elements according to a third embodiment of the present invention, coupled to one another and interacting with a locking element, during three distinct operating conditions.

With reference to FIGS. 9 to 11, a toy building element realized according to a further embodiment of the present invention is indicated as a whole by 2".

Since the toy building element 2" is similar, in terms of structure and function, to the toy building element 2 already described, only the distinctive features with respect to the latter will be explained in the following, while maintaining, wherever possible, the same references for similar or corresponding parts.

In particular, the toy building element 2" differs from the toy building element 2 in that the flaps 11 are configured to bend radially outwards by means of the insertion of such a locking stud 14 inside the relative cavity 13, to engage the respective seats 8, via the relative engaging elements 10, and cause the releasable coupling of the coupling part 6 carrying said flaps 11 to the receiving part 7 carrying said seats 8.

To this end, the flaps 11 delimit a narrowed section 15 of the relative cavity 13 having a cross-section smaller than the cross-section of the locking stud 14, so that, when the locking stud 14 engages the narrowed section 15, it causes a radial bending of the flaps 11 outwards.

More precisely, for each coupling stud 4, this narrowed section 15 is defined by a segment with the shape of a truncated cone, i.e. with a variable cross-section along the axis A, of the coupling part 6.

Thus, the flaps 11 according to this embodiment are convergent towards the respective axis A, over at least an axial portion of the same.

Conveniently, each narrowed section 15 is arranged at the free end of the relative coupling part 6, i.e. at the relative engaging elements 10 (FIGS. 9 and 10).

This way, when a locking stud 14 engages this narrowed section 15, it causes the flaps 11 to bend outwards (FIG. 11).

Thus, when the relative toy building elements 2 are coupled to one another, with the relative coupling parts 6 of one engaging the corresponding receiving parts 7 of the other, this bending of the flaps 11 outwards causes the interlocking of the engaging elements 10 with the respective seats 8.

A strong and durable yet simultaneously releasable coupling between the toy building elements 2 is obtained in this manner.

The advantages achieved by the present invention are evident from an examination of the features of the toy building element 2, 2', 2", and thus of the set 1, realized according to the present invention.

In particular, thanks to the presence of the cavities 13, each configured to be engaged by a locking stud 14, and to the unique configuration of the flaps 11, each configured to cooperate with the locking stud 14 inserted in the relative cavity 13, it is possible to establish a strong and durable yet simultaneously releasable coupling of the toy building elements 2, 2' which make up the set 1.

A certain solidity of the construction is thus ensured without depriving the user of the possibility of an easy disassembly.

It is clear that the toy building element 2, 2', 2", and thus the set 1, described and illustrated herein can be modified and varied without departing from the scope of protection defined by the claims.

In particular, the locking studs 14 may not form part of the set 1 according to the present invention. In this case, any stud element suited to the object and not part of the set 1 could be used for insertion inside each cavity 13.

In addition, each coupling stud 4 could comprise a radially flexible portion defining a flap 11 and a portion that is not flexible.

The invention claimed is:

1. A toy building element for a modular building game;

the toy building element comprising one or more hollow coupling studs for coupling the toy building element to another toy building element in a releasable manner;

each coupling stud extending along a respective longitudinal axis and internally defining an axial through cavity configured to receive, in a removable manner, a locking stud apt to lock the toy building element to another toy building element coupled thereto;

each coupling stud comprising a coupling part and a radially non-deformable receiving part for receiving the coupling part of a coupling stud of another toy building element;

the coupling part comprising at least a radially flexible portion for engaging/disengaging the receiving part of a coupling stud of another toy building element;

wherein the coupling part of a coupling stud of one toy building element is configured to engage the receiving part of a coupling stud of another toy building element without cooperating with the radially flexible portion of the coupling part of the coupling stud of the other toy building element, so that such radially flexible portion remains radially deformable so as to allow the coupling part of the one toy building element to disengage from the receiving part of the other toy building element; the radially flexible portion being configured to cooperate with one said locking stud engaging the cavity so that its radial bending is limited by the locking stud so as to prevent the coupling part from disengaging from the receiving part of a coupling stud of another toy building element.

2. The toy building element as claimed in claim 1, wherein each cavity has a widened portion arranged at the relative receiving part and defining at least one seat apt to house at least part of said radially flexible portion.

3. The toy building element as claimed in claim 2, wherein the radially flexible portion comprises at least one axial flap so shaped as to delimit at least part of the relative cavity and apt to bend radially to engage/disengage a corresponding seat of a receiving part of a coupling stud of another toy building element and configured to cooperate with a locking stud engaging the relative cavity.

4. The toy building element as claimed in claim 3, wherein the radially flexible portion comprises at least two said flaps opposite to one another, arranged on opposite sides of the relative cavity and apt to engage corresponding said seats of the receiving part of a coupling stud of another toy building element.

5. The toy building element as claimed in claim 4, wherein said flaps are configured to bend radially outwards by means of the insertion of one said locking stud inside the relative cavity, to engage said seats and cause the releasable coupling of the coupling part carrying said flaps to the receiving part carrying said seats.

6. The toy building element as claimed in claim 5, wherein the flaps delimit a narrowed section of the cavity having a cross-section smaller than a cross-section of the locking stud, so that, when the locking stud engages the narrowed section, it causes a radial bending of the flaps outwards.

7. The toy building element as claimed in claim 1, and comprising one or more coupling studs and one or more locking studs.

8. The toy building element as claimed in claim 1, and comprising a plurality of said coupling studs fixed, at their receiving parts, to a base body of the toy building element and arranged with the respective longitudinal axes parallel to one another.

9. A toy building set comprising a plurality of toy building elements as claimed in claim 1 and one or both amongst:

one or more toy locking elements, each being couplable in a releasable manner to one or more of said toy building elements and exclusively carrying one or more of said locking studs;

one or more of said locking studs configured to be inserted inside respective said cavities.

* * * * *